United States Patent [19]

Dornfeld

[11] Patent Number: 4,804,171

[45] Date of Patent: Feb. 14, 1989

[54] WORKPIECE HOLDING DEVICE

[76] Inventor: Stanley W. Dornfeld, 7414 Trade St., #"A", San Diego, Calif. 92121

[21] Appl. No.: 117,742

[22] Filed: Nov. 6, 1987

[51] Int. Cl.[4] ..... B25B 1/00

[52] U.S. Cl. ..... 269/138; 269/153; 269/234; 269/254 R

[58] Field of Search ..... 269/91–94, 269/99–101, 138, 234, 152, 153, 254 R

[56] References Cited

U.S. PATENT DOCUMENTS

| | | | |
|---|---|---|---|
| 620,495 | 2/1899 | Ramseaur | 269/234 |
| 744,559 | 11/1903 | Kendrick | 269/234 |
| 1,060,980 | 5/1913 | Hammann | 269/91 |
| 2,291,255 | 7/1942 | Powell | 269/254 R |
| 2,625,861 | 1/1953 | Swanson | 269/234 |
| 2,667,799 | 2/1954 | Rzepela | 269/138 |
| 2,733,492 | 2/1956 | Copell | 269/91 |
| 4,027,867 | 6/1977 | Pollington | 269/94 |
| 4,387,845 | 6/1983 | Mefferd | 269/48.1 |
| 4,505,010 | 3/1985 | Arenhold | 269/254 R |
| 4,643,411 | 2/1987 | Izumi | 269/138 |

*Primary Examiner*—Robert C. Watson

*Attorney, Agent, or Firm*—Charmasson & Holz

[57] ABSTRACT

A workpiece holding device which wedges against the side of a workpiece during machining operations to provide a clear surface for machining. A tool head having a clamping face and a wedge ramp face is attached to a flexible shaft and support structure. A wedge is pressed against the wedge ramp face by a hold down fastener which also secures the support structure. The multipurpose components produce a very lightweight, low profile holding device for use in machining operations.

8 Claims, 1 Drawing Sheet

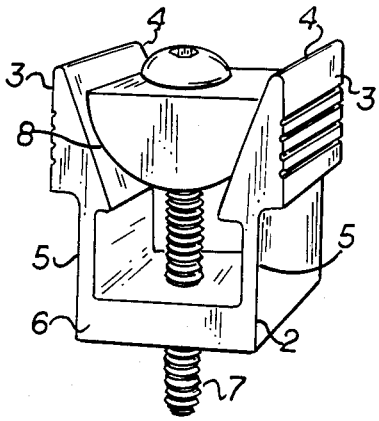
FIG. 1
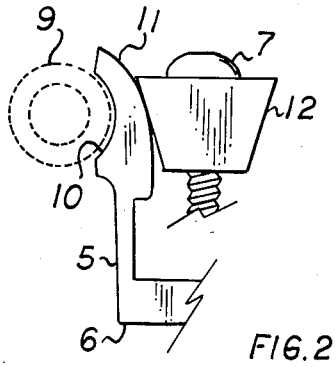
FIG. 2
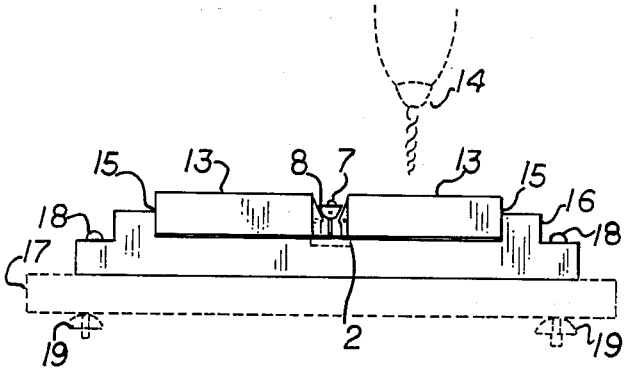
FIG. 3
FIG. 5
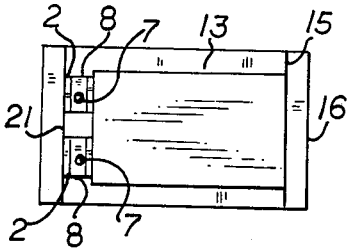
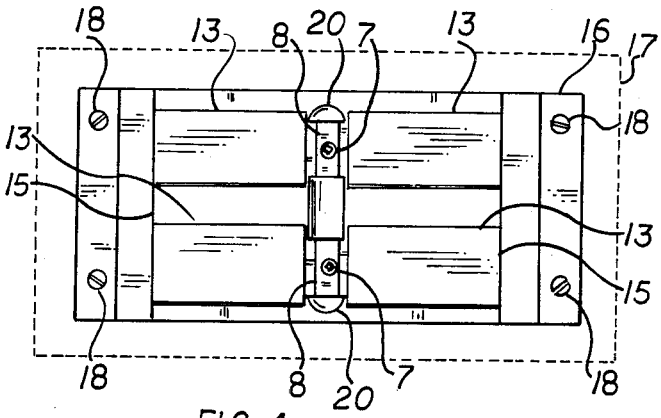
FIG. 4
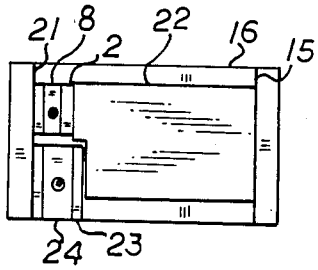
FIG. 6

WORKPIECE HOLDING DEVICE

FIELD OF THE INVENTION

This invention relates to adjustable work holders and clamps, and more specifically to metal working or deforming apparatus clamps, woodworking holders nd machine tool vises.

BACKGROUND OF THE INVENTION

Machining of equipment or components requires very sturdy restrains and hold downs of workpieces. Tolerances on machined surfaces can be very small, requiring not only no movement of the workpiece, but minimum stress and strain on the workpiece during machining. Since machining operations, by removing material, inherently produce high stress, one of the goals of holding devices is to quickly transfer these stresses from the workpiece to the machine tool bed or other support.

Many holding devices are available. The most common are vises. These are precision tools which clamp the workpiece between two long jaws which are secured to a vise structure which is attached to the machine tool bed. Jaws may have interchangeable faces to adapt to different workpiece shapes. Jaw are also designed to clamp and not protrude beyond surfaces not being machined into the plane of the surface being machined. The two long opposing jaw faces are parallel planes and require workpiece to present two parallel clamp planes for proper alignment.

This approach presents difficulties during machining of billets. Multiple cuts on each surface to be machined may be required. Alignment and restraint of billet by vise jaws gripping rough, as received billets or stock surfaces do not allow heavy cuts, alignment or final machining operations. This frequently requires multiple rough machining on long noncritical clamp surfaces just to mate with and allow long vise jaws to properly grip and position workpiece. These vises also require significant space on the machine tool bed.

These limitations are especially troublesome on numerically controlled machining equipment and/or for precision machining operations. Multiple cuts on clamping surfaces require delay and expense of unclamping, repositioning, alignment, and reclamping. Long precision reference surfaces must be established for final critical surface machining. Alignment and operation of multiple vises can be especially time consuming. These limitations are compounded when multiple workpieces are machined in a single operation.

SUMMARY OF THE INVENTION

The principal and secondary objects of this invention are:

to provide a machine tool bed workpiece holding device which requires little space;

to provide a holding device capable of holding two workpieces;

to provide a holding device which does not require long parallel machined surfaces on the workpiece;

to produce a low cost holding device; and to provide a low profile holding device which does not interfere with machining operations.

These and other objects are achieved by a U-shaped holder, wedge and threaded fastener. U-shaped holder comprises two heads, each having a clamping face on distal sides of the U-shaped holder and each having a wedge ramp face on the interior sides of the holder, each head attached to a flexible shaft and both shafts secured to a support structure. A threaded shaft secures support structure to the machine tool base and then holds the wedge against the wedge ramp faces. Holding device can be used individually, pressing a workpiece against a stationary reference ledge or ganged on more that two sides to fully secure workpiece. Clamping face may be configured to contact only small areas for small workpieces and gang applications to irregular shaped workpieces, configured for curved and angled areas for appropriate workpieces, or configured for gripping rough cut or as received workpieces. A variety of sizes can be used to adapt to the various dimensions of workpieces.

BRIEF DESCRIPTION OF THE DRAWING

FIG. 1 is a perspective view of a holding device;

FIG. 2 is a partial side view of an alternate configuration holding device;

FIG. 3 is a side view of several workpieces held against reference surfaces by a holding device;

FIG. 4 is a top view of several workpieces held against reference surfaces by two holding devices;

FIG. 5 is an alternate configuration of smaller holding devices restraining a single larger workpiece against a reference surface;

FIG. 6 is an alternate configuration of an irregular shape workpiece being secured by two different sizes of holding devices against a single reference surface.

DESCRIPTION OF THE PREFERRED EMBODIMENT OF THE INVENTION

FIG. 1 shows a perspective view of a workpiece holding device. U-shaped holder 2 includes two clamping faces 3 facing out, two wedge ramp faces 4, two flexible shafts 5 and a common support structure 6 attached to the flexible shafts 5. An Allen head screw 7 threadably engages a threaded hole in support structure 6 and the head of screw 7 also restrains wedge 8. Screw 7 also engages the machine tool bed or reference tool (not shown for clarity) to secure holder 2 and wedge 8. As screw 7 is rotated into base (not shown), screw head forces wedge 8 into wedge ramp 4 which deflects clamping faces 3 outward. Clamping faces may be serrated to improve grip.

FIG. 2 shows a partial side view of another embodiment of a workpiece holding device. Workpiece 9, shown dotted for clarity, is held by a single concave clamp face 10. Ramp face 11 is convex rather than planar as in FIG. 1. Wedge 12 has planar surfaces mating with ramp face 11 rather than convex as in FIG. 1. It should be understood that any combination of convex and planar ramp and wedge surfaces can be used. Allen head screw 7 engages base or tool (not shown) similar to FIG. 1 or FIG. 3. Flexible shaft 5 and support structure 6 are also similar to FIG. 1 except U-shape is not required to hold only one workpiece.

FIGS. 3 and 4 show a pair of a workpiece holding devices 2 holding four workpieces 13. Screw 7 drives wedge 8 against both ramp faces of holders 2, which forces clamping faces of holder 2 against both working pieces 13 below top surfaces to be machined by tool 14 (shown in dotted for clarity). Holder 2 forces working pieces against reference surfaces 15 of retainer fixture 16. Retaining tool 16 is clamped to slotted machine tool bed 17 (shown dotted for clarity) by two bolts 18 and wing nut 19 (shown dotted for clarity). Holders 2 and screws 7 do not protrude into the top surface plane of the workpieces 13. Screw 7 is threadably attached to tool 16.

FIG. 4 is a top view of two workpiece holding devices holding four workpieces 13 on retainer fixture 16 (shown dotted for clarity) by bolts 18. Screws 7 pass through slots 20 in the retainer fixture 16, and are threadably attached to nuts under fixture 16 (not shown for clarity).

FIG. 5 shows a top view of another configuration of smaller holding devices. Two screws 7 force wedge 8 into holders 2 which are resisted by tool reference surface 21 and workpiece 13 which rests against workpiece reference surface 15, both reference surfaces attached to retaining fixture 16. The small holding devices do not require a precision planar tool reference surface or planar workpiece surface to clamp against, with each holding device exerting clamp forces to the portions of surfaces it is in contact with.

FIG. 6 shows a top view of two holding devices retaining an irregular workpiece reference surface 15 and a tool reference surface 21. Workpiece 22 rests against workpiece reference surface 15 while holder 2 and large holder 23 are spread apart by wedge 8 and large wedge 24, securing against tool reference surface 21 and portions of workpiece 22.

Other configurations/modifications include: composite materials for flexible shafts to give added strength while maintaining the flexibility to form S-shapes to adapt to various workpieces, and sizes/dimensions of clamping faces.

While the preferred embodiment of the invention has been described and modifications thereto have been suggested, other applications and modifications could be made without departing from the spirit of the invention and the scope of the appended claims.

What is claimed is:

1. A workpiece holding device for retaining a first workpiece having a plurality of surfaces, said workpiece retained on a machine tool or assembly bed during operations on a first working surface by said device restraining motion of a second clamping surface orthogonal to said first working surface, which comprises;

a first generally rigid clamping head having a first clamping face, capable of being proximal to a clamping surface of said first workpiece, said first clamping head also having a first wedge ramp surface distal from said first clamping face;

a first flexible shaft attached at one end to said first clamping head, said first shaft shaped and having properties to allow deflection and rotation of said first clamping face towards said clamping surface in a direction generally perpendicular to said proximal clamping surface of said first workpiece;

a device support structure attached to the other end of said first flexible shaft;

a wedge having a surface shaped and dimensioned to deflect said first clamping face into said workpiece clamping surface when said wedge is translated along an axis generally parallel to said device clamping surface, wherein said wedge and clamping head do not intersect a plane generally defined by the proximate edges of said working surface;

means for removably attaching said support structure to said bed; and means for translating said wedge.

2. The holding device as claimed in claim 1, wherein said means for removably attaching and said means for translating said wedge consists of:

a threaded fastener shaft and head threadably connected to said machine tool bed and said support structure; and a bored passage in said wedge containing said fastener shaped to allow translation and rotation of said fastener shaft but not translation of said fastener head.

3. The holding device as claimed in claim 1, wherein said means for removably attaching and said means for translating said wedge consists of:

a reference fixture removably attached to said machine tool base;

a headed fastener threadably connected to said support structure and said reference fixture; and a bored passage in said wedge containing said fastener, said passage shaped to allow translation and rotation of said fastener shaft but not translation of said fastener head.

4. The holding device as claimed in claim 3, wherein said clamping face is serrated.

5. The holding device as claimed in claim 4 for also retaining a second workpiece which further comprises:

a second clamping head having a second clamping face proximal to a second workpiece surface not being machined when proximal said second clamping face, said second clamping head also having a second wedge ramp surface distal from said second clamping face; and a second flexible shaft attached at one end to said second clamping head, said second shaft shaped and having properties to allow deflection of said second head in a direction generally perpendicular to said proximal surface of said second workpiece and the other end of said second shaft attached to said device support structure in a manner to allow said wedge to deflect said first and second clamping faces into said first and second workpiece clamping surfaces when said wedge is translated along an axis generally parallel to said first workpiece clamping surface.

6. The holding device as claimed in claim 5, wherein said flexible shafts are made from soft steel.

7. The holding device as claimed in claim 5, wherein said flexible shafts are made from an elastomeric material.

8. The holding device as claimed in claim 5, wherein said flexible shafts are made from a composite of steel fibers in a elastomeric matrix.

* * * * *